US005707465A

United States Patent [19]

Bibber

[11] Patent Number: 5,707,465

[45] Date of Patent: Jan. 13, 1998

[54] LOW TEMPERATURE CORROSION RESISTANT ALUMINUM AND ALUMINUM COATING COMPOSITION

[75] Inventor: John W. Bibber, Batavia, Ill.

[73] Assignee: Sanchem, Inc., Chicago, Ill.

[21] Appl. No.: 740,200

[22] Filed: Oct. 24, 1996

[51] Int. Cl.[6] ..... C23C 22/66

[52] U.S. Cl. ..... 148/273; 148/275; 106/14.21

[58] Field of Search ..... 148/273, 275; 106/14.21

[56] References Cited

U.S. PATENT DOCUMENTS

| | | |
|---|---|---|
| 1,607,676 | 11/1926 | Jirota . |
| 1,677,667 | 7/1928 | Zimmerman . |
| 1,710,743 | 4/1929 | Page . |
| 1,811,298 | 6/1931 | Boulanger . |
| 1,965,269 | 7/1934 | Tosterud . |
| 1,971,240 | 8/1934 | Tosterud . |
| 1,988,012 | 1/1935 | Mason . |
| 2,127,206 | 8/1938 | Curtin . |
| 2,276,353 | 3/1942 | Thompson . |
| 2,465,443 | 3/1949 | Gide . |
| 2,512,493 | 6/1950 | Gide . |
| 2,516,877 | 6/1950 | Papafingos . |
| 2,681,873 | 2/1954 | Deniston . |
| 2,785,091 | 3/1957 | Rex . |
| 2,820,731 | 1/1958 | Heinzelman et al. . |
| 2,883,311 | 4/1959 | Halpert . |
| 2,981,647 | 4/1961 | Schwartz . |
| 3,573,997 | 4/1971 | Plaxton . |
| 3,706,604 | 12/1972 | Paxton . |
| 3,749,596 | 7/1973 | Nara . |
| 3,752,708 | 8/1973 | Newell et al. . |
| 3,871,881 | 3/1975 | Mickelsons . |
| 4,145,234 | 3/1979 | Meissner . |
| 4,427,458 | 1/1984 | Hasegawa et al. . |
| 4,504,324 | 3/1985 | Furuno . |
| 4,711,667 | 12/1987 | Bibber . |
| 4,755,224 | 7/1988 | Bibber . |
| 4,895,608 | 1/1990 | Bibber . |
| 4,988,396 | 1/1991 | Bibber . |
| 5,437,740 | 8/1995 | Bibber . |
| 5,554,231 | 9/1996 | Bibber ..... 148/273 |

FOREIGN PATENT DOCUMENTS

| | | |
|---|---|---|
| 1007070 | 4/1952 | France . |
| 856817 | 7/1949 | Germany . |
| 122879 | 12/1979 | Japan . |
| 1259617 | 1/1972 | United Kingdom . |
| 2195358 | 4/1988 | United Kingdom . |

OTHER PUBLICATIONS

Berdzenishvili, et al–72 Electrochemistry 15685 vol. 102, 1984.

Mikhailovskii, et al–Chemical Abstracts 182163u vol. 100, 1984.

Plenkova, et al .72 Electrochemistry93394c vol. 100,1984.

El–Sobki, et al 72 Electrochemistry 112211h vol. 96, 1982.

Bruno, et al—Chemistry Abstracts 97914z vol. 66, 1967.

Kravchenko, et al 20 Nonferrous Metals and Alloys, 6738.

Asada—Chemical Abstracts, vol. 64, p. 17044.

Reschke, et al—Chemical Abstracts vol. 36, p. 5760.

Collari, 9 Metallurgy and Metallography, p. 5814.

Collari, et al., Chemical Abstracts, p. 4760.

Seidell, et al., American Chemical Society, 1964.

F. Albert Cotton, et al 72 Advanced Inorganic Chem. 853, 25 D–6.

Grant, Hackh's Chem. Dictionary, 4th Ed., 1969, p. 114.

James T.Waber et al, Mathematical Studies on Galvanic Corrosion, vol. 103, No. 1, pp. 64–72.

*Primary Examiner*—Sam Silverberg

*Attorney, Agent, or Firm*—Laff, Whitesel, Conte & Saret, Ltd.

[57] ABSTRACT

A low temperature aluminum alloy or aluminum corrosion resistant coating has, as essential ingredients, water, 0% hexavalent chromium, an alkali metal permanganate providing at least 760 ppm permanganate, alkali metal or aluminum halide providing at least 100 ppm of halide, and a pH of from about 1.0 to about 4.0.

22 Claims, No Drawings

LOW TEMPERATURE CORROSION RESISTANT ALUMINUM AND ALUMINUM COATING COMPOSITION

The present invention relates to an aluminum and aluminum alloy low temperature corrosion resistant, non-hexavalent chromium coating composition and to methods of treating aluminum and aluminum alloy articles.

BACKGROUND OF THE INVENTION

Aluminum and aluminum alloys have been made corrosion resistant by providing a non-hexavalent chromium conversion coating thereon as disclosed in our U.S. Pat. Nos. 4,755,224; 4,711,667; 4,895,608 and 4,988,396, 5,437,740 and 5,554,231. These patents are generally related to aluminum conversion coatings and although they broadly cover aluminum coatings they generally disclose protecting aluminum and/or aluminum alloys by using a heated composition, preferably in the range of 140° F. or above.

Aluminum metal and it's alloys are still today mainly provide enhanced corrosion resistance, and or paint adhesion by being coated with a hexavalent chromium composition. These are well known toxic compositions that most manufacturers are trying to stop using.

SUMMARY OF THE INVENTION

Our invention eliminates some of the problems of hexavalent chromium, and other heavy metal compositions by providing at low temperatures, such as room temperature, aluminum and aluminum alloys with a non-hexavalent chromium permanganate coating. Room temperature non-hexavalent chromium conversion coating provides a low cost method of protecting aluminum and aluminum alloys with a non-hexavalent chromium conversion coating of permanganate.

Therefore, it is an object of the present invention to provide a low temperature aluminum alloy or aluminum coating composition comprising as essential ingredients, water, 0% hexavalent chromium, alkali metal permanganate providing at least 760 ppm (parts per million) permanganate, alkali metal halide or aluminum halide providing at least 100 ppm of halide, and a pH of from about 1.0 to about 4.0

It is another object of the present invention to provide a concentrated aluminum alloy or aluminum conversion coating composition for dilution to provide a conversion coating composition having a pH of from about 1.0 to about 4.0, 0% hexavalent chromium, alkali metal permanganate in an amount to provide a final aqueous conversion coating composition having at least 760 ppm of permanganate ion, and alkali metal halide in an amount to provide a halide ion concentration of at least about 100 ppm of halide.

It is another object of the present invention to provide a method of providing a corrosion resistant aluminum alloy or aluminum article that has no pitting when shortly after being coated is placed in a salt-spray at 95° F. according to ASTM specification B-117-94 for 100 hours of exposure by providing an aqueous conversion coating composition at room temperature and the conversion coating having as essential ingredients water, 0% hexavalent chromium, alkali metal permanganate, providing at least 760 ppm permanganate, alkali metal or aluminum halide providing at least 100 ppm halide and a pH of about 1.0 to about 4.0 and coating an aluminum alloy or aluminum article with the coating composition to provide the corrosion resistant aluminum alloy or aluminum article.

It is still a further object of the present invention to provide a method of providing a corrosion resistant aluminum alloy or aluminum article that has no pitting when shortly after being coated is placed in a salt-spray at 95° F. according to ASTM specification B-117-94 for 100 hours of exposure by providing a conversion coating composition at room temperature and the conversion coating having as essential ingredients, water, potassium or sodium permanganate providing a permanganate ion concentration of at least 760 ppm, an alkali metal halide selected from the group consisting of sodium chloride, sodium bromide, sodium fluoride, sodium iodide and aluminum chloride to provide the composition with a halide ion concentration of at least 100 ppm.

Other objects and advantages of the invention will become apparent by the following description of the invention.

DETAILED DESCRIPTION OF THE INVENTION

I treat the aluminum and/or aluminum alloy article with a non-hexavalent chromium alkali metal permanganate-halide aqueous solution having a pH of from about 1 to about 4. The alkali metal is selected from potassium, sodium or lithium. The preferred alkali metal permanganate is sodium or potassium permanganate. The halide is chlorine, fluorine, bromine or iodine with the chloride being preferred.

The alkali metal permanganate compositions may be applied in any acceptable manner (i.e., immersion, spraying, misting or spreading by an appropriate applicator). The aluminum or aluminum alloy surface is normally immersed in my aqueous alkali metal permanganate solution.

The other ingredients usually used are an acid or appropriate hydroxide to provide the above acid pH. There is no preferred source of acidity, however, some acids inhibit the formation of our conversion coating. Thus, the acid should not inhibit formation of the desired coating.

The permanganate ion concentration is at least 760 ppm. There is no upper limit except for the saturation point of the alkali metal permanganate in question.

The halide ion concentration is at least 100 ppm. There is no upper limit except for the solubility of the salt in question. The halide is supplied by an alkali metal halide or aluminum halide. The alkali metal is sodium, potassium or lithium.

The pH of the solution is from about 1.0 to about 4.0. A pH of less than 1.0 leads to the very rapid decomposition of a permanganate solution. Other non-chromium compounds may be added to the permanganate compositions provided they do not interfere with the desired corrosion resistance of the resulting conversation coating.

For the aluminum or aluminum alloy, I utilize an acid composition of permanganate ions, halide ions and, if desired, nitrate ions. The most preferred permanganate and halide are potassium permanganate and sodium halide or aluminum halide as stated above and the nitrate is aluminum nitrate.

The composition is effective in protecting aluminum and aluminum alloys for more than 100 hours and preferably more than 168 hours in salt fog at 95° F. according to standard ASTM method B-117-94. The process, of coating the aluminum or aluminum alloy is generally carried out by cleaning the aluminum or aluminum alloy and then coating the cleaned aluminum alloy or aluminum article with the permanganate-halide composition.

The temperature of the coating composition is room temperature with the preferred temperature range from about 60° F. to about 90° F. The preferred pH range is about 2.5 to about 4.0 with the most preferred pH being about 3.5 to about 4.0. The aluminum nitrate used is $Al(NO_3)_3.9H_2O$. The aluminum nitrate nine hydrate concentration when used is about 0.10% to about 10.0%.

The preferred method is by immersing the aluminum or aluminum alloy article in the aqueous solution for about 15 seconds to about 2 minutes to form the non-hexavalent chromium conversion coating.

Other non-hexavalent chromium compounds may be added to the permanganate solutions if desired, providing the compounds do not interfere with the desired corrosion resistant protection of the aluminum or aluminum alloy surfaces.

The cleaning compounds for the aluminum or aluminum alloy surfaces are trichloroethane, sodium hydroxide, potassium hydroxide, alkaline solutions of sodium nitrate, hydrofluoric acid, sulfuric acid, nitric acid, sodium carbonate, sodium bromate, borax, and a commercial non-ionic surfactant polyoxyethylene or polyoxypropylene derivatives of organic acids, alcohols, alkylphenols or amines.

After cleaning the aluminum or aluminum alloy surfaces, the cleaned aluminum or aluminum alloy is coated with the permanganate-halide composition at room temperature.

It is also recommended that neither the cleaning composition nor the corrosion resistant alkali metal permanganate composition contain a fatty acid, or any compound which would interfere with adhesion or formation of a protective coating on the surface of the aluminum or aluminum alloy article.

The following examples illustrate specific embodiments of my invention and are not intended to limit the scope of my invention to the specific embodiments shown.

In the following examples, all percentages are percentages by weight unless otherwise indicated.

Examples 1–9 are directed to aluminum and aluminum alloy articles protected according to the invention. Example 10 shows that using a halide of below 100 ppm does not provide an appropriate coating composition even when the aluminum alloy is immersed for five minutes. Example 11 shows that when the permanganate concentration is less than 760 ppm, a protective coating is not formed even though the aluminum alloy was immersed for five minutes. Example 12 shows that using a pH of 5 prevents a protective coating from being formed even though the aluminum alloy is immersed for five minutes.

EXAMPLE 1

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:

99.7735% Deionized Water
0.1100% Potassium Permanganate
0.1000% Aluminum Nitrate
0.0165% Sodium Chloride (100 ppm chloride ion)
pH adjusted to 4.0 with Sodium Hydroxide Within 15 seconds the metal developed a light gold color characteristic of the conversion coating. The metal was rinsed, dried and placed in a salt-spray at 95° F. according to "ASTM" specification B-117. After 168 hours of exposure, the panels showed no signs of pitting.

EXAMPLE 2

A 3" by 10" sheet of pure aluminum was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:

99.7735% Deionized Water
0.1100% Potassium Permanganate
0.1000% Aluminum Nitrate
0.0165% Sodium Chloride (100 ppm chloride ion)
pH adjusted to 4.0 with Sodium Hydroxide Within 15 seconds the metal developed a light gold color characteristic of the conversion coating. The metal was rinsed, dried and placed in a salt-spray at 95° F. according to "ASTM" specification B-117. After 168 hours of exposure, the panels showed no signs of pitting.

EXAMPLE 3

A 3" by 10" sheet of pure aluminum was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:

99.7679% Deionized Water
0.1100% Potassium Permanganate
0.1000% Aluminum Nitrate
0.0221% Sodium Fluoride (100 ppm fluoride ion)
pH adjusted to 4.0 with Sodium Hydroxide Within 15 seconds the metal developed a light gold color characteristic of the conversion coating. The metal was rinsed, dried and placed in a salt-spray at 95° F. according to "ASTM" specification B-117. After 168 hours of exposure, the panels showed no signs of pitting.

EXAMPLE 4

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:

99.7771% Deionized Water
0.1100% Potassium Permanganate
0.1000% Aluminum Nitrate
0.0129% Sodium Bromide (100 ppm Bromide ion)
pH adjusted to 4.0 with Sodium Hydroxide Within 15 seconds the alloy developed a light gold color and the solution began to decompose due to the much more rapid oxidation of bromide ion by the permanganate. The metal was rinsed, dried and placed in a salt-spray at 95° F. according to "ASTM" specification B-117. After 168 hours of exposure, the panels showed no signs of pitting.

EXAMPLE 5

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:

99.7782% Deionized Water
0.1100% Potassium Permanganate
0.1000% Aluminum Nitrate
0.0118% Sodium Iodide (100 ppm Iodide ion)
pH adjusted to 4.0 with Sodium Hydroxide Within 15 seconds the alloy developed a light gold color and the solution began to decompose due to the much more rapid oxidation of iodide ion by the permanganate. The metal was rinsed, dried and placed in a salt-spray at 95° F. according to "ASTM" specification B-117. After 168 hours of exposure, the panels showed no signs of pitting.

EXAMPLE 6

A 3" by 10" sheet of pure aluminum was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:
"Saturated Solution" Potassium Permanganate
0.20% Aluminum chloride
"Balance" Deionized Water
pH of the solution was 3.

Within 15 seconds the metal developed a light gold color characteristic of the conversion coating. The metal was rinsed, dried and placed in a salt-spray at 95° F. according to "ASTM" specification B-117. After 168 hours of exposure, the panels showed no signs of pitting.

EXAMPLE 7

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:
1.0% Sodium Permanganate
0.5% Potassium Chloride
98.5% D.I. Water
pH of the solution adjusted to 1.6 with Oxalic Acid Within 15 seconds the metal developed a light gold color characteristic of the conversation coating. The metal was rinsed, dried and placed in a salt-spray at 95° F. according to "ASTM" specification B-117. After 168 hours of exposure, the panels showed no signs of pitting.

EXAMPLE 8

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:
3.0% Potassium Permanganate
Saturated Solution Sodium Chloride
Balance D.I. Water
pH of the solution adjusted to 1.0 with Sulfuric Acid Within 15 seconds the metal developed a light gold color characteristic of the conversation coating. The metal was rinsed, dried and placed in a salt-spray at 95° F. according to "ASTM" specification B-117. After 168 hours of exposure, the panels showed no signs of pitting.

EXAMPLE 9

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 32° F.:
99.7735% Deionized Water
0.1100% Potassium Permanganate
0.1000% Aluminum Nitrate
0.0165% Sodium Chloride
pH adjusted to 4.0 with Sodium Hydroxide Within 15 seconds the alloy developed a light gold color characteristic of the conversation coating. The metal was rinsed, dried and placed in a salt-spray at 95° F. according to "ASTM" specification B-117. After 168 hours of exposure, the panels showed no signs of pitting.

EXAMPLE 10

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:
99.774% Deionized Water
0.110% Potassium Permanganate
0.100% Aluminum Nitrate
0.010% Sodium Chloride (60.6 ppm Chloride ion)
pH adjusted to 2.0 with Sulfuric Acid After 5.0 minutes of exposure at 70° F., no coating had formed on the metal's surface.

EXAMPLE 11

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:
99.7935% Deionized Water
0.0900% Potassium Permanganate (678 ppm permanganate ion)
0.1000% Aluminum Nitrate
0.0165% Sodium Chloride (100 ppm Chloride ion)
pH adjusted to 1.0 with Sulfuric Acid After 5.0 minutes of exposure at 70° F., no coating had formed on the metal's surface.

EXAMPLE 12

A 3" by 10" sheet of "6061-T6" alloy was degreased in trichlorethylene, cleaned in a non-ionic detergent, rinsed in D.I. water, deoxidized in 10% nitric acid solution at 70° F. for one minute and given a final rinse in D.I. water. The metal was then placed in the following solution at 70° F.:
99.5835% Deionized Water
0.3000% Potassium Permanganate
0.1000% Aluminum Nitrate
0.0165% Sodium Chloride (100 ppm Chloride ion)
pH adjusted to 5.0 with Boric Acid After 5.0 minutes of exposure at 70° F., no coating had formed on the metal's surface.

The above examples and data are for purposes of illustration rather than limitation of the scope of protection accorded this invention. The scope of this invention is to be measured by the following claims which should be interpreted as broadly as the invention permits.

I claim:

1. A low temperature aluminum alloy or aluminum corrosion resistant coating composition comprising as essential ingredients, water, 0% hexavalent chromium, an alkali metal permanganate providing at least 760 ppm permanganate, alkali metal or aluminum halide providing at least 100 ppm of halide, and a pH of from about 1.0 to about 4.0.

2. The composition of claim 1 wherein said low temperature is room temperature.

3. The composition of claim 2 wherein the alkali metal permanganate is selected from the group consisting of sodium permanganate and potassium permanganate, the halide is selected from the group consisting of alkali metal chloride, alkali metal fluoride, alkali metal bromide, alkali metal iodide and aluminum halide.

4. The composition of claim 3 wherein the alkali metal permanganate is potassium permanganate.

5. The composition of claim 4 wherein the halide is selected from sodium chloride, sodium bromide, sodium fluoride, sodium iodide and aluminum chloride.

6. The composition of claim 5 wherein the composition also contains aluminum nitrate.

7. A concentrated aluminum alloy or aluminum conversion coating composition for dilution to provide a low temperature conversion coating composition having a pH of from about 1.0 to about 4.0 comprising:

0% hexavalent chromium, alkali metal permanganate in an amount to provide a final aqueous conversion coating composition having at least 760 ppm of permanganate, and a halide in an amount to provide a halide ion concentration of at least about 100 ppm of halide.

8. The composition of claim 7 wherein said low temperature is room temperature.

9. The composition of claim 8 wherein the alkali metal permanganate is selected from the group consisting of sodium permanganate and potassium permanganate, the halide is selected from the group consisting of alkali metal chloride, alkali metal fluoride, alkali metal bromide, alkali metal iodide and aluminum halide.

10. The composition of claim 9 wherein the alkali metal permanganate is potassium permanganate.

11. The composition of claim 10 wherein the halide is selected from sodium chloride, sodium bromide, sodium fluoride, sodium iodide and aluminum chloride.

12. The composition of claim 11 which also contains aluminum nitrate.

13. A method of providing a corrosion resistant aluminum alloy or aluminum article that has no pitting when shortly after being coated is placed in a salt-spray at 95° F. according to ASTM specification B-117-94 for 100 hours of exposure comprising;

providing a low temperature conversion coating composition having as essential ingredients, water, 0% hexavalent chromium, an alkali metal permanganate providing at least 760 ppm permanganate, alkali metal or aluminum halide providing at least 100 ppm of halide, and a pH of from about 1.0 to about 4.0 coating at said low temperature an aluminum alloy or aluminum article with said coating composition.

14. The method of claim 13 wherein said low temperature is room temperature.

15. The method of claim 14 wherein the alkali metal permanganate is selected from the group consisting of sodium permanganate and potassium permanganate and the halide is selected from the group consisting of alkali metal chloride, alkali metal fluoride, alkali metal bromide, alkali metal iodide and aluminum halide.

16. The method of claim 15 wherein the alkali metal permanganate is potassium permanganate.

17. The method of claim 16 wherein the halide is selected from sodium chloride, sodium bromide, sodium fluoride, sodium iodide and aluminum chloride.

18. The method of claim 17 wherein the composition also contains aluminum nitrate.

19. A method of providing a corrosion resistant aluminum alloy article comprising:

providing a low temperature conversion coating having as essential ingredients, water, 0% hexavalent chromium, an alkali metal permanganate providing at least 760 ppm permanganate, alkali metal or aluminum halide providing at least 100 ppm of halide, and a pH of from about 1.0 to about 4.0; and coating at said low temperature an aluminum alloy or aluminum article with said coating composition to provide the aluminum alloy or aluminum article that has no pitting when placed in a salt-spray at 95° F. according to ASTM specification B-117 for 100 hours of exposure within 10 minutes of being coated.

20. The composition of claim 19 wherein the alkali metal permanganate is selected from the group consisting of sodium permanganate and potassium permanganate, and the halide is selected from the group consisting of alkali metal chloride, alkali metal fluoride, alkali metal bromide, alkali metal iodide and aluminum halide.

21. The composition of claim 20 wherein the alkali metal permanganate is potassium permanganate.

22. The composition of claim 21 wherein the composition also contains aluminum nitrate.

* * * * *